US005925977A

United States Patent [19]

Sugawara et al.

[11] Patent Number: 5,925,977

[45] Date of Patent: Jul. 20, 1999

[54] STRENGTHENED GLASS BULB FOR A CATHODE RAY TUBE

[75] Inventors: Tsunehiko Sugawara; Toshihide Murakami, both of Funabashi, Japan

[73] Assignee: Asahi Glass Company Ltd., Tokyo, Japan

[21] Appl. No.: 08/958,562

[22] Filed: Oct. 27, 1997

[30] Foreign Application Priority Data

Oct. 30, 1996 [JP] Japan ..... 8-288706

[51] Int. Cl.[6] ..... H01J 31/00

[52] U.S. Cl. ..... 313/477 R; 348/821; 220/2.1 A

[58] Field of Search ..... 313/477 R, 479, 313/480; 220/2.1 A, 2.3 A, 2.3 R; 348/821, 823

[56] References Cited

U.S. PATENT DOCUMENTS 4,537,322 8/1985 Okada et al. ..... 220/21 R 4,580,077 4/1986 Bakker et al. ..... 313/477 R 4,990,825 2/1991 Tsukui et al. ..... 313/479

5,814,933 9/1998 Iwata et al. ..... 313/477 R

*Primary Examiner*—Sandra O'Shea

*Assistant Examiner*—Michael Day

*Attorney, Agent, or Firm*—Oblon, Spivak, McClelland, Maier & Neustadt, P.C.

[57] ABSTRACT

A glass bulb for a cathode ray tube in which a compressive stress is formed in a surface of a panel portion by physically strengthening; the maximum wall thickness $t_F$ of a face portion 7 on at least one axis of a long axis and a short axis of the face portion and the maximum wall thickness $t_R$ of a blend R portion satisfy $1.0 \leqq t_R/t_F \leqq 1.4$; and the absolute value of a compressive stress value by physically strengthening in an area where a tensile vacuum stress is distributed after the assembling of the cathode ray tube is 7–30 MPa, whereby there is a small possibility of implosion of the glass bulb even when the wall thickness of the panel portion is made thin in comparison with a conventional glass bulb.

6 Claims, 3 Drawing Sheets

STRENGTHENED GLASS BULB FOR A CATHODE RAY TUBE

BACKGROUND OF THE INVENTION

1. Field of the Invention

The present invention relates to a glass bulb for a cathode ray tube used mainly for receiving signals of TV broadcasting or the like.

2. Discussion of Background

As shown in FIGS. 1 and 2, a cathode ray tube 1 used for receiving signals for TV broadcasting or the like has a glass bulb 2 which is basically constituted by a panel glass or a panel portion 3 for displaying a picture image, a funnel portion 4 on which a deflection coil is mounted, and a neck portion 5 for housing an electron gun 17.

In FIGS. 1 and 2, reference numeral 6 designates a skirt portion in the panel portion 3, numeral 7 designates a face portion for displaying a picture image in the panel portion, numeral 8 designates an implosion-proof reinforcing band for providing strength, numeral 9 designates a blend R portion for connecting the face portion to the skirt portion, numeral 10 designates a sealing portion at which the panel portion 3 and the funnel portion 4 are sealed with solder glass or the like, numeral 12 designates a fluorescent layer for emitting fluorescence by irradiating electron beams, numeral 13 designates an aluminum film for reflecting forwardly the fluorescence at the fluorescent film, numeral 14 designates a shadow mask which specifies positions of fluorescent substance irradiated by the electron beams, numeral 15 designates a stud pin for fixing the shadow mask 14 to the inner surface of the skirt portion 6, and numeral 16 designates an inner conductive coating which prevents the shadow mask 14 from being charged to a high potential by the electron beams and which grounds electric charges to the outside.

A symbol A indicates a tube axis connecting the central axis of the neck portion 5 to the center of the panel portion 3. The fluorescent layer is formed on an inner plane of the panel glass to thereby form a screen. The screen is in substantially rectangular shape which is constituted by four lines which are in substantially parallel to a long axis and a short axis crossing at a right angle to the tube axis at the central point of the rectangular shape.

In the cathode ray tube 1 using the glass panel having a substantially box-like configuration, there are a region having a large tensile stress (a sign of "+") and a region having a compressive stress (a sign of "−") in a relatively broad area at the edge of the face portion on the short axis and the long axis, which are resulted from an asymmetric structure unlike a spherical shape, and in an outer surface of the skirt portion in the vicinity of the blend R portion, as shown in FIG. 3, because a pressure difference of 1 atmospheric pressure between the outside and the inside of the panel glass is applied thereto. In FIG. 3, a symbol $\sigma_R$ represents a component of stress along the paper surface and a symbol $\sigma_T$ represents a component of stress perpendicular to the paper surface. Numerical values described near distribution lines of stress in FIG. 3 indicate the values of stress at corresponding positions.

There is a two-dimensional distribution of stress in the front surface of the glass bulb. Generally, the maximum value of tensile vacuum stress exists in an edge portion of an image displaying surface of the face portion of the panel glass or the skirt portion of the panel glass. Accordingly, if the tensile vacuum stress produced in the glass bulb of the cathode ray tube is large and if the glass bulb does not have a sufficient strength to oppose the tensile vacuum stress, there may result a static fatigue breakage due to the atmospheric pressure and the glass bulb will not function as the cathode ray tube.

Further, in the manufacture of the cathode ray tube, the glass bulb is kept at a high temperature such as about 380° C. and air inside the glass bulb is evacuated. During such heating process, a thermal stress is resulted in addition to the tensile vacuum stress. In a worse case, an intensive implosion is resulted due to an instantaneous introduction of air and the reaction thereof whereby there is a danger of causing a damage in the neighborhood. As a guarantee to prevent such breakage of the glass bulb or glass panel, an external pressure loading test has been conducted by applying a pressure to the glass bulb to which scratches are uniformly formed by using a #150 emery paper, in consideration of the depth of the scratches in the glass surface which may be produced in an assembling step of the glass bulb and the cathode ray tube, and the service life of the cathode ray tube. Then, a difference between an inner pressure and an outer pressure at the time when the glass bulb is broken is measured. The glass bulb is generally so constructed as to be durable to a pressure difference of 3 atmospheric pressure or more.

The fracture strength of the glass bulb with the scratches is not primarily determined because the tensile vacuum stress in the outer surface of the glass bulb depends on the structure of the glass bulb and has a two-dimensional distribution of stress. Generally, the fracture strength is within 18.6 MPa at the minimum value and about 24.5 MPa in average.

On the other hand, in consideration of the fatigue breakage of the glass bulb due to a vacuum stress. There is a high possibility of causing the breakage of the glass bulb in a region having the maximum tensile vacuum stress $\sigma_{Vmax}$. Accordingly, the wall thickness and the shape of the glass bulb are determined so that the maximum value $\sigma_{Vmax}$ is in a range of from 6 to 12 MPa. Namely, the face portion is formed to have a certain extent of radius of curvature and wall thickness whereby the vacuum stress is reduced. Further, in general attempt, an edge portion of the face portion is made thicker while the face portion is not thickened as a whole whereby the vacuum stress is reduced by a wedge effect. Accordingly, the blend R portion is made thicker than the other portions.

In recent years, there is a demand of increasing the size of cathode ray tubes. In this case, when the radius of curvature of the face portion is small, there arises a problem of visibility of a picture surface. In order to eliminate the problem of the visibility, there is a proposal that the radius of curvature of the face portion be asymmetrically formed whereby the radius of curvature of the face portion can be increased by about 2 times or 3 times, and the above-mentioned range of the maximum tensile vacuum stress can be achieved without inviting a substantial increase in the thickness of the face portion. For example, when the maximum value of the outer diameter of the panel portion corresponds to that of 29-inch model, the radius of curvature of the face portion on the diagonal axis is increased to about 2400 mm while the radius of curvature on the short axis can be made small to 1400 mm. Thus, a sufficient visibility can be assured by minimizing the height difference at the peripheral portion of the face portion, and the maximum tensile vacuum stress can be reduced by reducing the radius of curvature of the face portion on the short axis.

However, when the radius of curvature of the face portion is to be further increased, for example, when the face portion is formed to have a flattened shape in terms of the 29-inch model while the above-mentioned value of the maximum tensile vacuum stress is to be maintained, the wall thickness of the face portion is increased to 18.5 mm. Therefore, Japanese Unexamined Patent Publications JP-A-7-21944 and JP-A-7-142013 propose physically strengthening is effectively conducted to a region where the tensile vacuum stress is the largest, i.e., a heat treatment is so conducted that a desired compressive stress is provided to the surface layer where the wall thickness can be reduced while the strength is maintained.

Generally, the panel glass is formed by pressing operations at a high temperature of about 1000° C. Then, a physically strengthening method is conducted in such a manner that a heat treatment is applied to the glass panel so that there produces an effective temperature difference between the core and the surface of the glass at at least a temperature region which permits the rearrangement of molecules forming the glass.

In the conventional panel portion, however, the wall thickness of the blend R portion is fairly thicker than that of the face portion or the skirt portion located near the blend R portion as shown in FIG. 4. Accordingly, when the glass panel is cooled for strengthening, there is found a delay of cooling in the region adjacent to the face portion and the skirt portion which are connected to the blend R portion at which a large tensile vacuum stress is produced because the thermal capacity of the blend R portion is large and a change in the shape of the blend R portion is large. As a result, a compressive stress formed in the surface layer by the physical strengthening is smaller than that in the core of the face portion.

Accordingly, when a large stress value by strengthening is to be obtained in this region, the strengthened stress values of the core of the face portion and the seal edge portion of the skirt portion become excessive, and a tensile plane stress is newly developed in an inner surface or an outer surface of the edge portion of the face portion in order to avoid such imbalance state of the stress distribution. Further, the presence of the thick wall portion provides unstable cooling. Further, there is a problem of difficulty in controlling the strengthened stress value in this region.

SUMMARY OF THE INVENTION

It is an object of the present invention to provide a glass bulb which is strengthened without a danger of implosion of a cathode ray tube while the maximum tensile vacuum stress can be reduced.

In accordance with the present invention, there is provided a glass bulb for a cathode ray tube which comprises a panel portion with a face portion of substantially rectangular shape and a skirt portion forming a side wall for the face portion, a funnel portion and a neck portion, wherein a compressive stress is formed at at least an outer surface of the panel portion by physically strengthening; there is a relation of $1.0 \leqq t_R/t_F \leqq 1.4$ between the maximum wall thickness $t_F$ of the face portion on at least one axis of a long axis and a short axis which pass through the center of the face portion and which cross at a right angle, and the maximum wall thickness $t_R$ of a blend R portion for connecting the skirt portion; and a formula of $7\ \text{MPa} \leqq |\sigma_c| \leqq 30\ \text{MPa}$ is satisfied where σc is a compressive stress value by physically strengthening in at least an area including a position at which the maximum tensile vacuum stress $\sigma_{Vmax}$ is formed after the assembling of the cathode ray tube.

Further, in accordance with the present invention, there is provided a glass bulb for a cathode ray tube which comprises a panel portion with a substantially flat face portion of substantially rectangular shape and a skirt portion forming a side wall for the face portion, a funnel portion and a neck portion, wherein a compressive stress is formed at at least an outer surface of the panel portion by physically strengthening; there is a relation of $1.0 \leqq t_R/t_F \leqq 1.3$ between the maximum wall thickness $t_F$ of the face portion on at least one axis of a long axis and a short axis which pass through the center of the face portion and which cross at a right angle, and the maximum wall thickness $t_R$ of a blend R portion for connecting the skirt portion; and a formula of $7\ \text{MPa} \leqq |\sigma_c| \leqq 30\ \text{MPa}$ is satisfied where σc is a compressive stress value by physically strengthening in at least an area including a position at which the maximum tensile vacuum stress $\sigma_{Vmax}$ is formed after the assembling of the cathode ray tube.

Further, in accordance with the present invention, there is provided a glass bulb for a cathode ray tube according to the above-mentioned inventions, wherein there is a relation of $t_R \leqq R_b$ between the maximum wall thickness $t_R$ of the blend R portion and the radius of curvature $R_b$ of the blend R portion in general.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 5*a*–5*e* are diagrams in cross section showing a molding process for the panel portion of the glass bulb of the present invention wherein FIG. 5*a* and FIG. 5*b* are respectively enlarged cross-sectional view of a portion A.

DETAILED DESCRIPTION OF THE PREFERRED EMBODIMENTS

Figure 1:
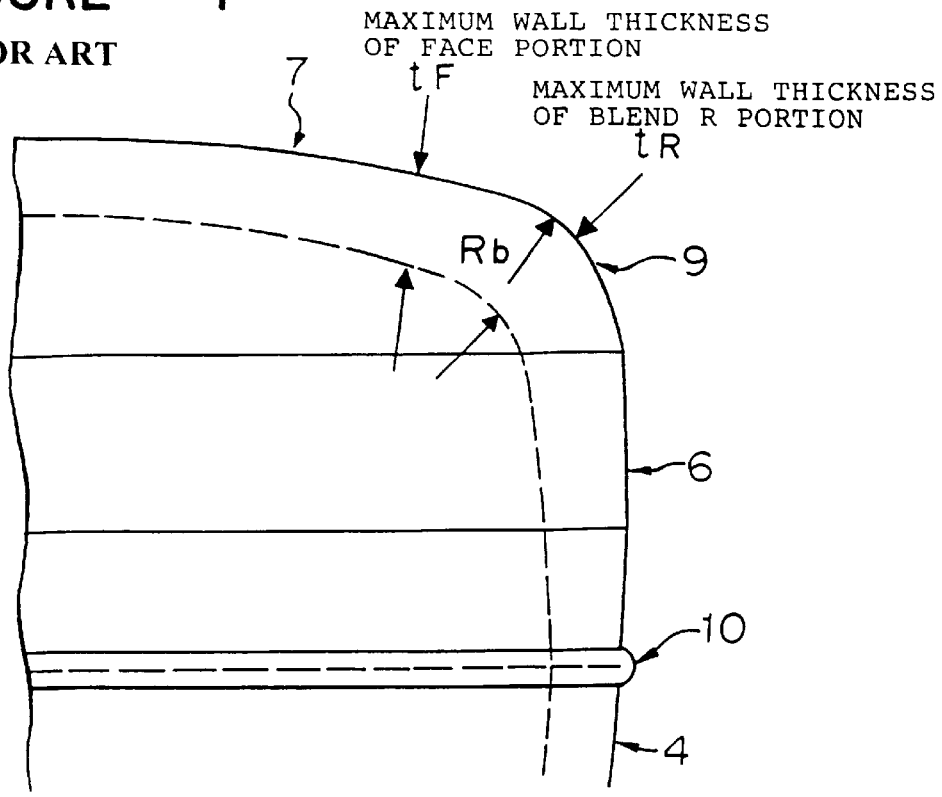
FIGURE 1 PRIOR ART
FIG. 1 is an enlarged cross-sectional view partly omitted of an embodiment of the panel portion of the glass bulb for a cathode ray tube in accordance with the present invention.

The present invention will be described with reference to the drawings wherein the same reference numerals designated the same or corresponding parts.

In the present invention, the wall thickness and the configuration of the connecting region between a face portion and a skirt portion in a panel glass for a cathode ray tube are specified. Thus, a strengthened compressive stress value of a portion near the connecting region is increased when the panel glass is subjected to a strengthening treatment or a heat treatment after a press-forming operation, whereby a tensile vacuum stress formed after the assembling of the cathode ray tube can be reduced.

The heat treatment for strengthening is generally conducted at a glass surface temperature of about 600° C.–380° C. However, since the glass panel has an ununiform distribution in the wall thickness and the three dimensional shape, and it is difficult to cool uniformly the glass panel, there produces a fairly irregular distribution of temperature in the connecting region. As the wall thickness of the blend R portion is larger, the heat capacity is larger so that a heat current is generated from the blend R portion to the neighbor portions during the cooling step. As a result, a strengthened stress at a position near the blend R portion, where the maximum tensile vacuum stress takes place, is decreased after the assembling of the cathode ray tube. Therefore, in order to prevent the strengthened stress from being too little in comparison with the strengthened stress value of the central portion of the face portion, the ratio $t_R/t_F$ of the maximum wall thickness $t_R$ of the blend R portion to the maximum wall thickness $t_F$ of the face portion in the axis on which the maximum tensile vacuum stress is produced is 1.4 or lower.

Further, the ratio $t_R/t_F$ should be 1.0 or more in order to reduce a pressure in a pressing operation with use of a mold as shown in FIG. 5 when a glass gob heated to about 1000° C. is pressed in the mold.

On the other hand, a distribution of tensile vacuum stress produced after the assembling of the cathode ray tube depends on the value of a radius of curvature $R_b$ of the blend R portion. As $R_b$ is larger, the distribution of tensile vacuum stress spreads. However, $\sigma_{Vmax}$ is reduced, and the strength of the glass bulb after strengthening is increased. When $t_F \leqq R_b$ in particular, the effect is remarkable.

Further, in the present invention, an effective range of strengthened stress value for the region which provides the $\sigma_{Vmax}$ value is specified by contriving the configuration of the blend R portion. As described above, the strengthened compressive stress value becomes larger as a temperature difference between the inside and the surface of the glass panel required for the strengthening treatment is larger. When the strengthened compressive stress value in the connecting region is smaller than 5 MPa, a quantity of heat flowing from the blend R portion to the neighboring portions become small. Accordingly, effect obtained by the shape of the glass panel in the present invention becomes small, and the strengthened stress value does not show a large difference in comparison with the shape by the conventional technique. In order to obtain a relatively remarkable effet, a strengthened stress value of 7 MPa or more is necessary.

On the other hand, when the strengthened stress value is larger than 30 MPa, it is difficult to control a balance of cooling between the face portion and the skirt portion. As a result, a needless tensile plane stress is produced in the connecting region, or an inner or an outer surface near the corner portion, hence, it is not practical. Further, when an angle formed by the face portion and the skirt portion in a portion near the blend R portion of the glass panel is close to a right angle, it is difficult to transmit uniformly heat from the face portion and the skirt portion in the strengthening treatment, and there produces an imbalance of cooling. Accordingly, either of the face portion or the skirt portion near the blend R portion receives a larger amount of heat. Accordingly, when the panel glass has a substantially flat face portion, a range of $t_R/t_F \leqq 1.3$ is preferable in order to obtain the effect of the present invention.

There is a restriction of the strength of the panel glass after the assembling of the cathode ray tube due to a region where the maximum tensile stress $\sigma_{Vmax}$ is substantially produced. Accordingly, it is important to improve the strength of the region. The inventors of this application have paid attention to directions of the short axis and the long axis to which the formation of the maximum tensile stress $\sigma_{Vmax}$ is recognized structurally and experimentally, and they could improve the strength of the region, which was the most problematic in terms of strength, by physically strengthening and changing the panel shape.

In a preferred embodiment of the present invention, the radius of curvature of the blend R portion which is the connecting portion between the face portion and the skirt portion is uniform or is simply reduced from the center of a long side or a short side intersecting with the short axis or the long axis of the face portion toward the corner potions. Further, the maximum wall thickness $t_R$ of the blend R portion or $t_F$ is simply increased toward the corner portions. However, the rate of increase varies depending mainly on the shape and the size of the panel glass, and is not primarily determined.

Now, the present invention will be described in detail with reference to Examples. However, it should be understood that the present invention is by no means restricted by such specific Examples.

EXAMPLE 1 (present invention) and EXAMPLE 2 (Comparative Example)

Figure 2:
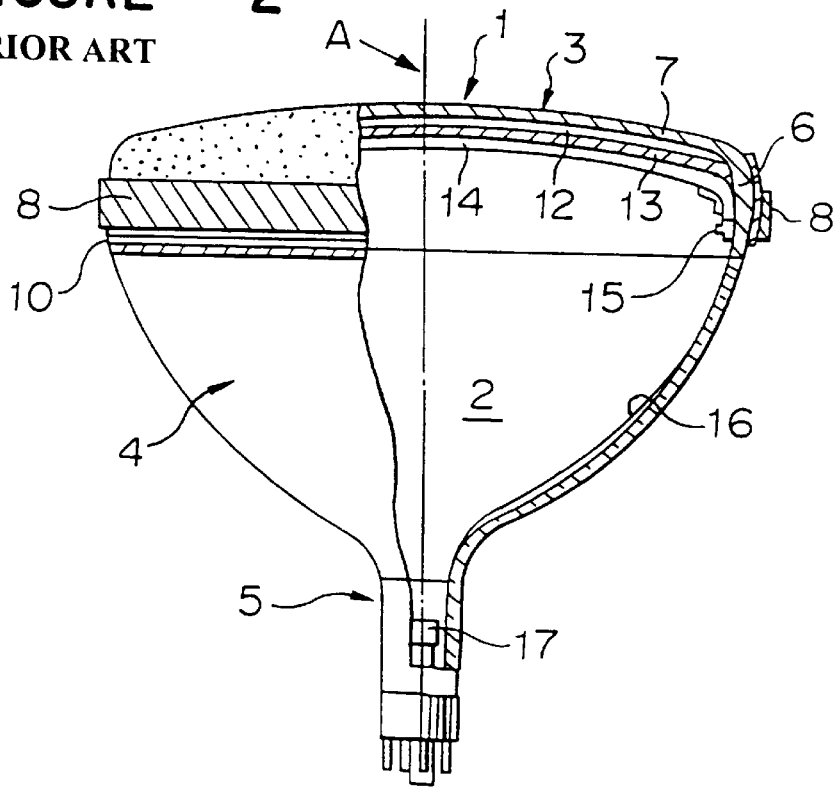
FIGURE 2 PRIOR ART
FIG. 2 is a vertically cross-sectional view of an embodiment of a cathode ray tube in which the glass bulb according to the present invention is used.
Figure 3:
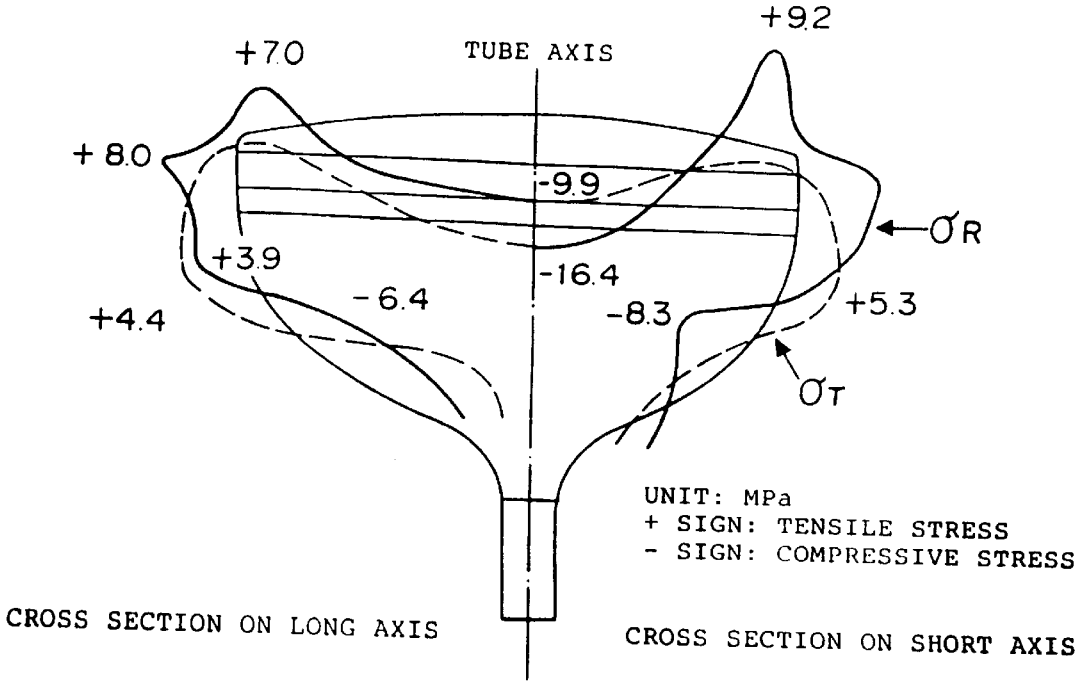
FIGURE 3 PRIOR ART
FIG. 3 is a diagram showing a stress distribution in a conventional glass bulb for a cathode ray tube.
Figure 4:
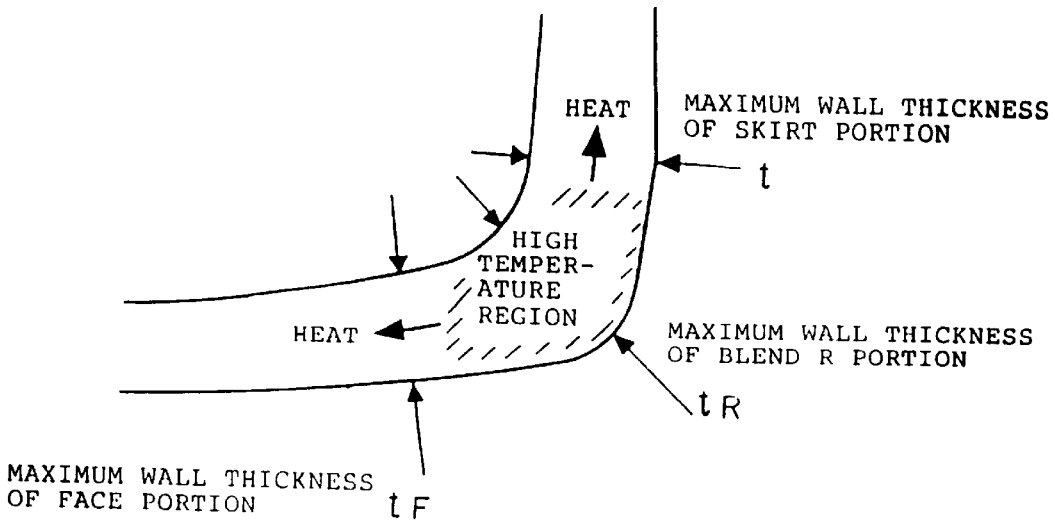
FIG. 4 is an enlarged cross-sectional view partly omitted of a blend R portion in the panel portion of the glass bulb for a cathode ray tube according to the present invention.
Figure 5C:
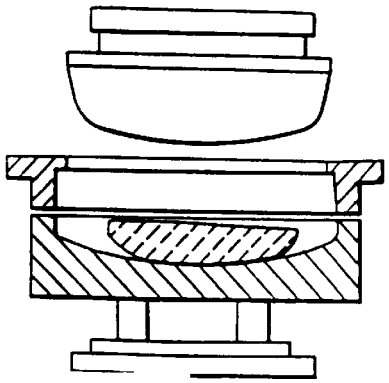
Figure 5D:
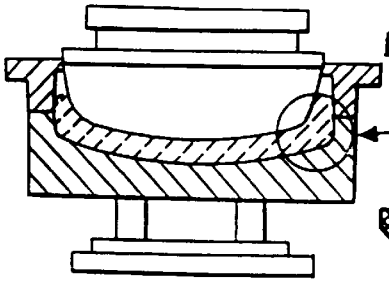
Figure 5E:
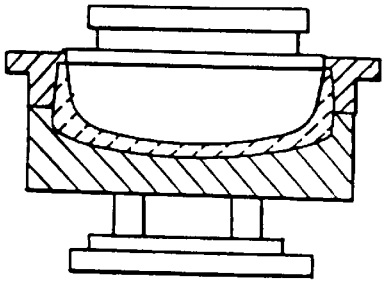
Figure 5A:
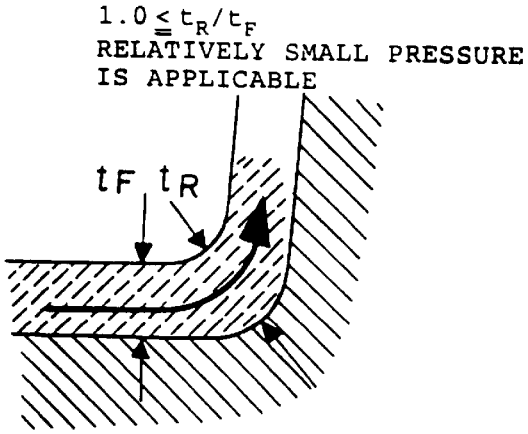
Figure 5B:
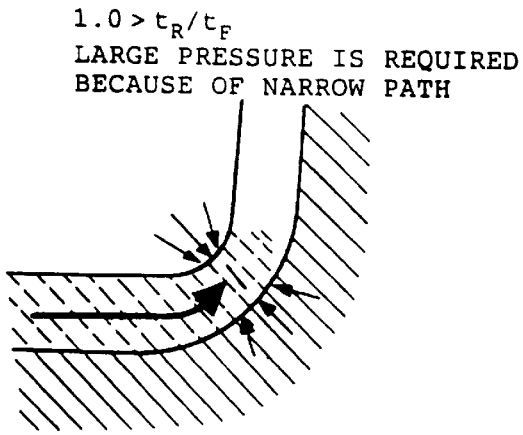

In Example 1, a glass bulb was prepared by using glass materials having properties as shown in Table 2, the glass bulb being generally used for a cathode ray tube for color TV as shown in FIG. 2. In Table 2, "title" indicates the tradename of products manufactured by Asahi Glass Company Ltd.

The glass bulb had the same configuration as a conventional glass bulb (Example 2) for TV for 29-inch model having an useful screen area of an aspect ratio of 4:3 and of a diagonal line of 68 cm except for the maximum wall thickness $t_R$ and the radius of curvature $R_b$ of the blend R portion of the short axis and the radius of curvature of the blend R portion on the long side which changes continuously from $R_b$ on the short axis toward the corner portion. The dimensions of these glass bulbs are shown in Table 1 wherein the maximum outer diameter of the panel and the size of the useful screen area are indicated by the length of the diagonal line. By changing the radius of curvature $R_b$ of the blend R portion from 8.0 mm (Example 2) to 12.5 mm, the maximum wall thickness $t_R$ of the blend R portion was reduced from 24.4 mm (Example 2) to 22.5 mm.

Further, by the evacuation of air inside the glass bulb, the maximum tensile vacuum stress $\sigma_{Vmax}$ is formed on the short axis in an edge portion of the useful screen area in an outer surface of the face portion. The values of the maximum tensile vacuum stress are shown in Table 1 wherein the stress value could be reduced from 8.5 MPa (Example 2) to 8.3 MPa.

In Examples 1 and 2, the glass bulbs were strengthened by the same heat treatment. Values of strengthened compressive stress formed in the central portion of the face portion and an edge of the face portion on the short axis are shown in Table 1. Although there was found no substantial difference between Examples 1 and 2 with respect to the strengthened stress value $\sigma_{CO}$ at the central portion of the face portion, the strengthened stress value $\sigma_{CE}$ at the edge portion of the face portion in Example 1 was improved from 7.7 MPa (Example 2) to 9.4 MPa and $\sigma_{CO}/\sigma_{CE}$ was improved from 0.46 to 0.56 respectively.

EXAMPLE 3 (present invention)

A glass bulb having the same shape as that of Example 1 was prepared by using the same glass materials except for the maximum wall thickness $t_R$ and the radius of curvature $R_b$ of the blend R portion on the short axis and the radius of curvature of the blend R portion on the long side which changes continuously from $R_b$ on the short axis toward the corner portion in Example 2.

When the radius of curvature $R_b$ of the blend R portion on the short axis was further increased to 20.0 mm, the maximum tensile vacuum stress $\sigma_{Vmax}$ was reduced from 8.5 MPa to 8.1 MPa even though the wall thickness of the blend R portion was reduced from 24.4 mm (Example 2) to 17.9 mm.

In Example 3, the glass bulb was strengthened by using the same heat treatment as in Example 2. The value of strengthened compressive stress formed in the central portion of the face portion and an edge portion of the face portion on the short axis are shown in Table 1. Although there was found no substantial difference between Examples 3 and 2 with respect to the strengthened stress value $\sigma_{CO}$ in the central portion of the face portion, the strengthened stress value $\sigma_{CE}$ in the edge portion of the face portion in Example 3 was improved from 7.7 MPa (Example 2) to 12.5 MPa and $\sigma_{CO}/\sigma_{CE}$ was improved from 0.46 to 0.74 respectively.

EXAMPLE 4 (present invention) and EXAMPLE 5 (Comparative Example)

A glass bulb was manufactured by using the same glass materials as in Example 1. The glass bulb had the same shape as the conventional glass bulb (Example 5) for a 28-inch model TV having a substantially flat face portion, an useful screen area of an aspect ratio of 16:9 and of a diagonal line of 66 cm except for the maximum wall thickness $t_R$ of the blend R portion on the short axis, the radius of curvature $R_b$ of the blend R portion and the radius of curvature of the blend R portion on the long side which changes continuously from $R_b$ on the short axis toward the corner portion. The dimensions of the glass bulb are shown in Table 1. When the radius of curvature $R_b$ of the blend R portion was changed from 17.5 mm (Example 5) to 25.0 mm, the maximum wall thickness $t_R$ of the blend R portion was reduced from 22.2 mm (Example 5) to 19.5 mm.

When air inside the glass bulb is evacuated, the maximum tensile vacuum stress $\sigma_{Vmax}$ is formed on the short axis in an edge portion of the useful screen area at an outer surface of the face portion. The value is shown in Table 1. The stress value could be reduced from 9.6 MPa (Example 5) to 9.2 MPa.

Further, in Examples 4 and 5, the same heat treatment was used for strengthening. The values of strengthened compressive stress formed in the central portion of the face portion and an edge portion of the face portion on the short axis are shown in Table 1. Although there was found no difference between Examples 4 and 5 with respect to the strengthened stress value $\sigma_{CO}$ in the central portion of the face portion, the strengthened stress value $\sigma_{CE}$ in the edge portion of the face portion in Example 4 was improved from 6.6 MPa (Example 5) to 10.6 MPa and $\sigma_{CO}/\sigma_{CE}$ was improved from 0.41 to 0.66 respectively.

TABLE 1

| | Example 1 | Example 2 | Example 3 | Example 4 | Example 5 |
|---|---|---|---|---|---|
| Maximum outer diameter of panel | 72 cm | 72 cm | 72 cm | 71 cm | 71 cm |
| Aspect ratio | 4:3 | 4:3 | 4:3 | 16:9 | 16:9 |
| Effective size of picture surface | 68 cm | 68 cm | 68 cm | 66 cm | 66 cm |
| Wall thickness at the center of face portion | 13.5 mm | 13.5 mm | 13.5 mm | 15.0 mm | 15.0 mm |
| Radius of curvature of outer surface of face portion | | | | | |
| Short axis | 1350 mm | 1350 mm | 1350 mm | 100000 mm | 100000 mm |
| Long axis | 1930 mm | 1930 mm | 1930 mm | 100000 mm | 100000 mm |
| Radius of curvature of inner surface of face portion | | | | | |
| Short axis | 1100 mm | 1100 mm | 1100 mm | 14500 mm | 14500 mm |
| Long axis | 1740 mm | 1740 mm | 1740 mm | 12700 mm | 12700 mm |
| $R_b$ (Short axis) | 12.5 mm | 8.0 mm | 20.0 mm | 25.0 mm | 17.5 mm |
| $t_F$ (Short axis) | 17.2 mm | 17.2 mm | 17.2 mm | 15.9 mm | 15.9 mm |
| $t_R$ (Short axis) | 22.5 mm | 24.4 mm | 17.9 mm | 19.5 mm | 22.2 mm |
| $t_R/t_F$ | 1.32 | 1.42 | 1.04 | 1.23 | 1.40 |
| Deflection angle | 108° | 108° | 108° | 102° | 102° |
| $\sigma_{Vmax}$ (MPa) | 8.3 | 8.5 | 8.1 | 9.2 | 9.6 |
| $\sigma_{CO}$ (MPa) | 16.7 | 16.8 | 16.9 | 16.6 | 16.0 |
| $\sigma_{CE}$ (MPa) | 9.4 | 7.7 | 12.5 | 10.6 | 6.6 |
| $\sigma_{CE}/\sigma_{CO}$ | 0.56 | 0.46 | 0.74 | 0.66 | 0.41 |

TABLE 2

| Glass | Panel glass | Funnel glass | Neck glass |
|---|---|---|---|
| Title (tradename) | 5008 | 0138 | 0150 |
| Density ($g/cm^3$) | 2.79 | 3.00 | 3.29 |
| Young modules (GPa) | 75 | 69 | 62 |
| Poisson ratio | 0.21 | 0.21 | 0.23 |
| Softening point (° C.) | 703 | 663 | 643 |

TABLE 2-continued

| Glass | Panel glass | Funnel glass | Neck glass |
|---|---|---|---|
| Annealing point (° C.) | 521 | 491 | 466 |
| Distortion point (° C.) | 477 | 453 | 428 |

In accordance with the present invention, a glass bulb in which a strengthened compressive stress is formed in at least a surface of a panel portion by a physically strengthening method, is provided wherein a relation of the wall thickness of a blend R portion which connects a face portion to a skirt portion of the panel portion to the wall thickness of the face portion in the vicinity of the blend R portion is specified, and the magnitude of the compressive stress is specified, whereby a strengthened stress value in a region where a relatively large tensile vacuum stress is formed after the assembling of a cathode ray tube is increased while the strengthened stress value is not too small in comparison with a strengthened stress value of the central portion of the face portion and the sealing portion of the skirt portion so that an effective distribution of strengthened stress value is produced in an outer surface of the panel portion.

Further, with the above-mentioned specified relation, it is possible to control a balance of cooling between the face portion and the skirt portion, and a needless compressive plane stress produced in the above-mentioned region or an inner or outer surface near the connecting portion of the corner portions can be reduced.

Further, by specifying the relation between the radius of curvature and the wall thickness of the blend R portion in the above-mentioned region, the tensile vacuum stress can be reduced. Thus, a glass bulb for a cathode ray tube which prevents implosion during the assembling work of the cathode ray tube and a fatigue breakage after the assembling can easily be obtained.

Obviously, numerous modifications and variations of the present invention are possible in light of the above teachings. It is therefore to be understood that within the scope of the appended claims, the invention may be practiced otherwise than as specifically described herein.

What is claimed is:

1. A glass bulb for a cathode ray tube which comprises a panel portion with a face portion of substantially rectangular shape and a skirt portion forming a side wall for the face portion, a funnel portion and a neck portion, wherein a compressive stress is formed in at least an outer surface of the panel portion by physically strengthening; there is a relation of $1.0 \leqq t_R/t_F \leqq 1.4$ between the maximum wall thickness $t_F$ of the face portion on at least one axis of a long axis and a short axis which pass through the center of the face portion and which cross at a right angle, and the maximum wall thickness $t_R$ of a blend R portion for connecting the skirt portion; and a formula of 7 MPa$\leqq|\sigma|\leqq$30 MPa is satisfied where σc is a compressive stress value by physically strengthening in at least an area including a position at which the maximum tensile vacuum stress $\sigma_{max}$ is formed after the assembling of the cathode ray tube.

2. A glass bulb for a cathode ray tube according to claim 1, wherein there is a relation of $t_R \leqq R_b$ between the maximum wall thickness $t_R$ of the blend R portion and the radius of curvature $R_b$ of the blend R portion in general.

3. A cathode ray tube which has the panel portion as defined in claim 1.

4. A glass bulb for a cathode ray tube according to claim 1, wherein there is a relation of $1.0 \leqq t_R/t_F \leqq 1.3$ between the maximum wall thickness $t_F$ of the face portion on at least one axis of a long axis and a short axis which pass through the center of the face portion and which cross at a right angle, and the maximum wall thickness $t_R$ of a blend R portion for connecting the skirt portion; and a formula of 7 MPa$\leqq|\sigma_c|\leqq$30 MPa is satisfied where σc is a compressive stress value by physically strengthening in at least an area including a position at which the maximum tensile vacuum stress $\sigma_{Vmax}$ is formed after the assembling of the cathode ray tube.

5. A glass bulb for a cathode ray tube according to claim 4, wherein there is a relation of $t_R \leqq R_b$ between the maximum wall thickness $t_R$ of the blend R portion and the radius of curvature $R_b$ of the blend R portion in general.

6. A cathode ray tube which has the panel portion as defined in claim 4.

* * * * *